US005727979A

United States Patent [19]

Spector

[11] Patent Number: 5,727,979

[45] Date of Patent: Mar. 17, 1998

[54] CRAFT KIT FOR PRODUCING TOY FIGURES

[76] Inventor: Donald Spector, 380 Mountain Rd., Union City, N.J. 07080

[21] Appl. No.: 746,469

[22] Filed: Nov. 12, 1996

[51] Int. Cl.[6] ..... A63H 33/14; A63H 3/06; A63H 3/36; B05D 1/28

[52] U.S. Cl. ..... 446/87; 446/226; 446/385; 434/84; 427/260; 427/261; 427/265

[58] Field of Search ..... 446/87, 89, 98, 446/99, 223, 226, 385, 386, 387; 434/82, 84; 427/260, 261, 265, 268, 388

[56] References Cited

U.S. PATENT DOCUMENTS

| | | | |
|---|---|---|---|
| 140,831 | 4/1873 | Brock | 446/385 |
| 1,150,792 | 8/1915 | Switzler | 446/87 |
| 1,205,779 | 11/1916 | Peck | 434/84 X |
| 1,321,135 | 11/1919 | Smith | 446/385 |
| 1,692,346 | 11/1928 | Nitschke et al. | 446/87 |
| 1,935,353 | 11/1933 | Coventry | 434/84 |
| 3,041,778 | 7/1962 | Seron | 446/87 |
| 4,294,634 | 10/1981 | Mookil | 434/84 X |
| 4,416,632 | 11/1983 | Berman | 434/84 |
| 4,584,042 | 4/1986 | Wandroik | 427/265 X |

FOREIGN PATENT DOCUMENTS

| | | | |
|---|---|---|---|
| 912716 | 12/1962 | United Kingdom | 446/226 |
| 941546 | 11/1963 | United Kingdom | 446/226 |
| 2214830 | 9/1989 | United Kingdom | 446/226 |

*Primary Examiner*—Robert A. Hafer
*Assistant Examiner*—D. Neal Muir
*Attorney, Agent, or Firm*—Michael Ebert

[57] ABSTRACT

A craft kit for children having minimal craft skills, making it possible for a child to create a toy figure, such as a miniature dinosaur, and to decorate this figure. Included in the kit is a collapsible cloth casing which when erected then assumes the shape of the desired figure, and a rubber balloon which is inserted in a deflated state into the casing through an opening therein. The cloth casing is impregnated with a curable resin and the balloon inflated to erect the casing so that it assumes the shape of the figure whereby when the resin cures, the casing is then rigidified to create the toy figure. The balloon is then deflated and withdrawn from the figure which may then be painted or otherwise decorated by the child.

5 Claims, 1 Drawing Sheet

CRAFT KIT FOR PRODUCING TOY FIGURES

BACKGROUND OF INVENTION

1. Field of Invention

This invention relates generally to the making of toy figures; such as miniature dinosaurs, and more particularly to a craft kit for this purpose which makes it possible for a child having minimal craft skills to create hollow toy figures and to decorate these figures.

2. Status of Prior Art

Craft kits for children are universally popular, for they enable a child having minimal skills to create objects which normally require high-level skills.

Thus it takes a high order of skill for a sculptor, using a chisel and mallet, to transform a block of marble into a human or animal-like figure, the sculptor having to chip away the marble block until it assumes the form of the figure. But a craft kit is known in which a molded plastic figure, such as that of a boy is encased in a block formed of clay or other is easily chipped material. The kit includes a chisel and a mallet which are used by the child to chip away the clay until the encased figure is released from the block. Thus a child with minimal craft skills is seemingly able to effectively achieve the same results as that obtained by a skilled sculptor.

One well-known method of forming shaped figures of metal or other moldable materials is by the lost wax process, also referred to as investment casting. In this method, the figure to be produced is sculpted in wax and mounted on expendable sprues to form an assembly. This assembly is then invested or surrounded by a refractory mold. The mold is then heated to melt out the wax and thereby expose the mold cavity. The cavity is then filled with molten metal which cools and hardens to reproduce in metal the wax figure.

A craft kit in accordance with the invention includes a cloth casing and a rubber balloon which is inserted within the casing and is inflated therein.

Of prior art interest therefore is the Spector U.S. Pat. No. 5,035,426 which discloses a ball of spherical or elliptical shape created by a balloon inflated within a casing having formed of cloth or other non-stretchable sheeting the desired ball shape. As pointed out in this patent, a balloon normally assumes a globular shape when inflated. But when the balloon is inflated within the confines of a shaped, non-stretchable casing, its rubber skin then stretches to then conform to the interior surface of engage and casing.

SUMMARY OF INVENTION in view of the foregoing, the main object of this invention is to provide a craft kit useable by children having minimal skills to create a hollow toy figure.

More particularly, an object of this invention is to provide a kit of the above type in which the figure to be produced is defined by a non-stretchable cloth casing which when erected by an inflated balloon has the shape of the figure.

A significant feature of a kit in accordance with the invention is that no molding operations or chiseling is required to create the shaped toy figure, for the child only need inflate the balloon confined within the casing and coat the casing erected by the inflated balloon with a curable rein. To carry out these operations, little skill is required. However, the child may exercise his artistic skills after he has converted the cloth casing into a rigid hollow figure, for then he can paint or otherwise decorate this figure in any way which expresses his artistic sensibilites.

Also an object of this invention is to provide a craft kit which is inexpensive to manufacture and is safe to use, for no component of the kit is in any way hazardous or toxic.

Briefly stated, these objects are attained by a craft kit for children having minimal craft skills, making it possible for a child to create a toy figure such as a miniature dinosaur, and to decorate this figure. Included in the kit is a collapsible cloth casing which when erected then assumes the shape of the desired figure, and a rubber balloon which is inserted in a deflated state into the casing through an opening therein.

The cloth casing which is non-stretchable is impregnated with a curable resin and the balloon inflated to erect the casing so that it assumes the shape of the figure whereby when the resin cures, the casing is then rigidified to create the toy figure. The balloon is then deflated and withdrawn from the figure which may then be painted or otherwise decorated by the child.

BRIEF DESCRIPTION OF DRAWING

For a better understanding of the invention, as well as further features thereof, reference is made to the detailed description thereof to be read in connection with the annexed drawings wherein.

DESCRIPTION OF INVENTION

The Kit

Figure 1:
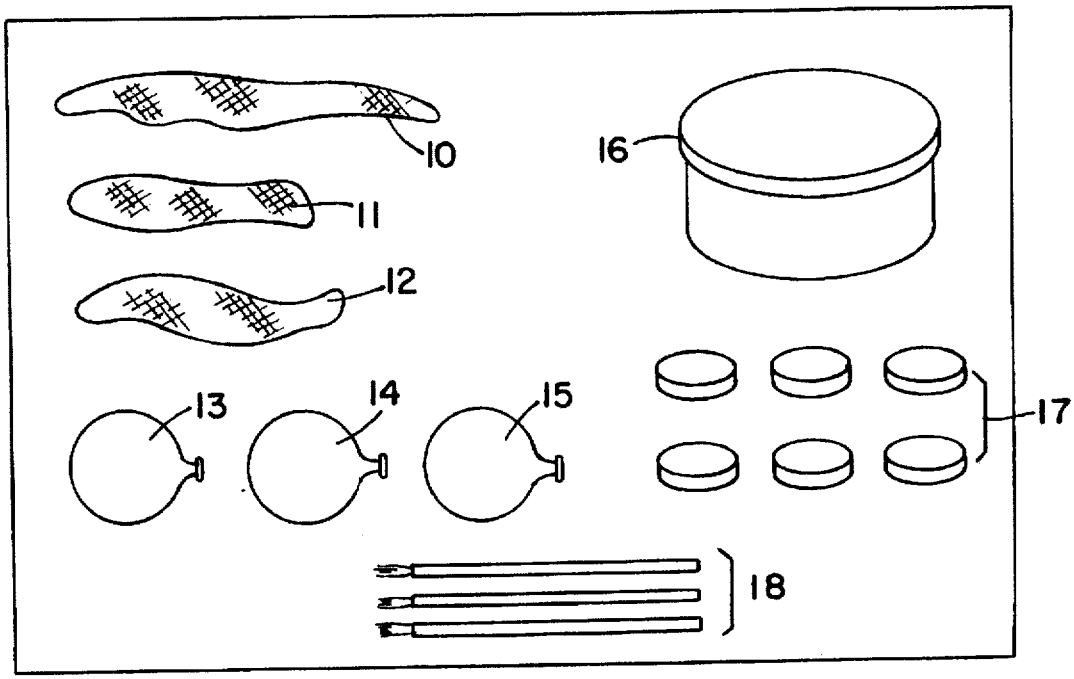
FIG. 1 schematically illustrates the components which make up a kit in accordance with the invention.

Referring now to FIG. 1, there is illustrated schematically the several articles which make up a craft kit in accordance with the invention for producing toy figures.

Included in the box containing the kit are three flattened collapsible cloth casings 10, 11 and 12, each of which when erected assumes the shape of a desired toy figure. Thus when erected, casing 10 assumes the shape of a miniature dinosaur, casing 11 that of a seal, and casing 12 that of an alligator. The number of cloth casings included in the kit depends on the size and cost of the kit which in its simplest and least expensive form includes only a single cloth casing. When casings 10, 11 and 12 are collapsed and flattened, they take relatively little space in the kit box.

The cloth casing may be fabricated of any suitable woven or non-woven non-stretchable material using natural or synthetic fibers in the manner disclosed in the above-identified Spector patent. The cloth casing in this prior patent is formed by shaped sections of fabric sheeting that are sewn together to create the desired ball form.

Also included in the kit are three deflated rubber balloons 13, 14, 15, each balloon having a protruding neck for inflating the balloon by mouth. The number of balloons included in the kit corresponds to the number of casings.

The kit is provided with a can 16 containing a curable resin, the capacity of the can being such as to supply sufficient resin for coating the three cloth casings. The resin may be any curable non-toxic monomer capable of polymerizing when exposed to air at room temperature in a relatively brief period. Suitable for this purpose is ethylene which when polymerized forms polyethylene or a vinyl chloride resin which polymerizes to form PVC.

Also provided in the kit is a set of water-based paints 17 of different color stored in small cups, and a set of brushes 18.

Use of Kit

By way of example we shall now explain how a child using cloth casing 10 can create a hollow toy miniature dinosaur figure. Cloth casing 10 has a slit or opening therein at an inconspicuous position through which a child inserts deflated balloon 13 whose neck projects out of the slit.

Figure 2:
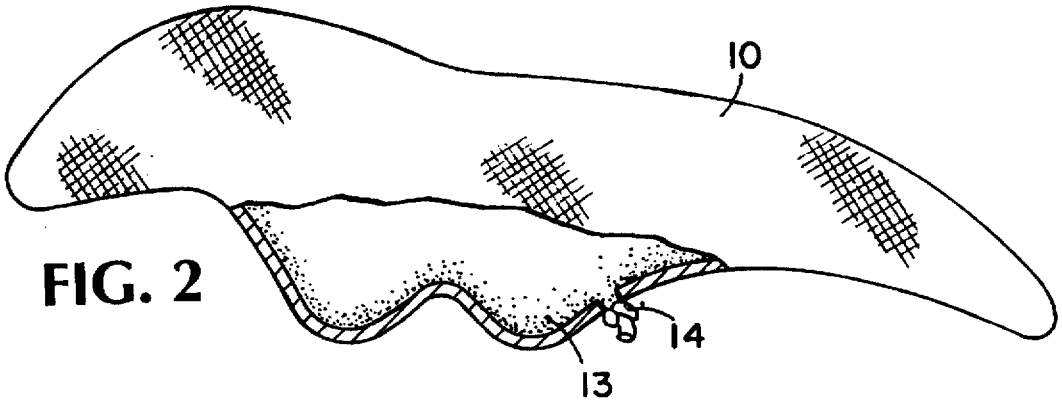
FIG. 2 illustrates an intermediate step in creating a miniature toy dinosaur figure.

The child then mouth-inflates balloon 13 so that, as shown in FIG. 2, casing 10 is erected thereby. While a balloon, when inflated, normally assumes a globular shape, when balloon 13 is inflated within the confines of the shaped casing 10, the balloon is subjected to air internal pressure, and its rubber skin is stretched thereby to engage and conform to the contours of the casing, so that the casing is fully erected. Neck 14 of the fully inflated balloon is then tied outside the slit of the casing to seal the inflated balloon.

The child, then using a brush 18, or another suitable applicator, applies to the outer surface of the erected cloth casing, a coating of curable resin taken from can 16, being careful to leave no area of the casing uncoated.

The resin impregnated in the casing cloth has a relatively short curing time such as 10 minutes. When the resin impregnated in the cloth casing cures and hardens, this acts to rigidify the casing which is now self-supporting. At this point the balloon is no longer necessary, and it may be deflated by puncturing it through the slit in the casing, the deflated balloon being then withdrawn from the casing, leaving a hollow rigid casing in the shape in this instance of a toy miniature dinosaur which is now in condition for decoration by the child.

Figure 3:
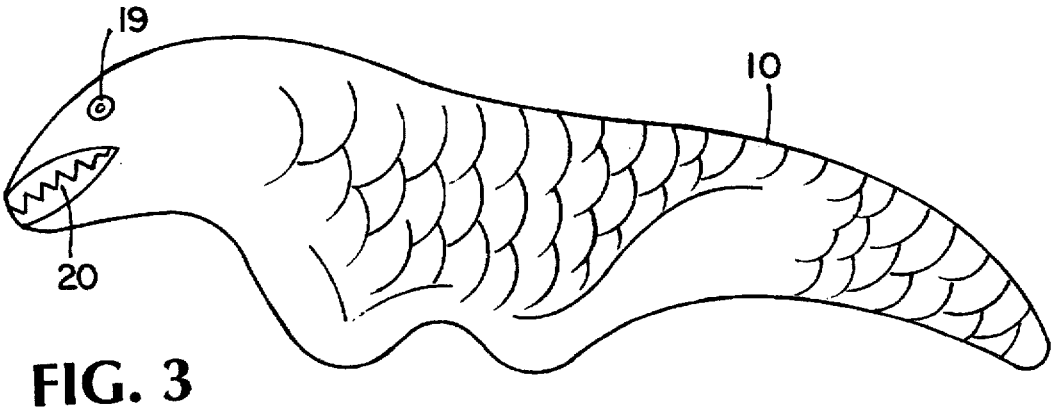
FIG. 3 illustrates the completed figure after it has been decorated.

In practice, the child may paint the dinosaur figure with colors taken from set 17, painting thereon eyes 19 and large teeth 20 as well as other features found in dinosaurs as shown in FIG. 3. Or the child may add greater body to the hollow casing by coating the casing with a layer of plaster of Paris and painting this layer before it sets.

The limits imposed on the shaped cloth casing are determined by the ability of an inflated balloon to stretch within the confines of the casing to engage and conform to all regions of the casing. Hence the casing figure cannot have a nose or trunk so elongated that an inflated balloon cannot stretch all of the way into the nose without bursting.

While there has been shown and described a preferred embodiment of a craft kit for producing toy figures, it will be appreciated that many changes and modifications may be made therein without, however, departing from the essential spirit thereof.

I claim:

1. A method for producing a hollow toy figure, such as that of a miniature dinosaur comprising the steps of:

A. forming a collapsible cloth casing whose contours are such that when the casing is erected it has the shape of the toy figure;

B. inserting into the casing through an opening therein a collapsed balloon whose neck projects from the opening to permit mouth inflation;

C. inflating the balloon within the casing to cause the balloon to engage and confirm to the contours of the casing and thereby erect the casing; and D. impregnating the cloth casing with a curable resin which when cured rigidifies the erect casing to create the toy figure.

2. A method as set forth in claim 1, further including the steps of deflating the inflated balloon and withdrawing it from the rigidified casing.

3. A method as set forth in claim 1, further including the step of painting the rigidified casing to impart a distinctive appearance thereto.

4. A method as set forth in claim 1, further including the step of applying a layer of plaster of Paris to the erect casing to impart body thereto.

5. A method as set forth in claim 4, including the step of painting the plaster layer before it sets.

* * * * *